United States Patent [19]

Wallace

[11] Patent Number: 4,934,986

[45] Date of Patent: Jun. 19, 1990

[54] BALLOONS CONNECTED TOGETHER

[75] Inventor: Cornelius J. Wallace, Bronx, N.Y.

[73] Assignee: S.E.N.O.C.T. Corporation, Bronx, N.Y.

[21] Appl. No.: 325,083

[22] Filed: Mar. 17, 1989

Related U.S. Application Data

[63] Continuation of Ser. No. 107,793, Oct. 13, 1987, abandoned.

[51] Int. Cl.[5] ..... A63H 3/06

[52] U.S. Cl. ..... 446/222; 446/220

[58] Field of Search ..... 446/220, 221, 222, 223, 446/224, 225, 226; 273/58 B, 58 C, 58 K

[56] References Cited

U.S. PATENT DOCUMENTS

| | | | |
|---|---|---|---|
| 1,211,369 | 1/1917 | Miller | 446/222 |
| 2,646,019 | 7/1953 | Chetlan | 446/220 X |
| 3,041,779 | 7/1962 | Carter et al. | 446/220 |
| 3,174,455 | 3/1965 | Peterson | 446/220 X |
| 3,470,845 | 10/1969 | Mignano | 273/58 K X |
| 3,900,638 | 8/1975 | Du Bato | 446/220 X |
| 4,463,513 | 8/1984 | Wallace | 446/222 |

FOREIGN PATENT DOCUMENTS

| | | | |
|---|---|---|---|
| 810660 | 3/1937 | France | 446/220 |

*Primary Examiner*—Robert A. Hafer

*Assistant Examiner*—Sam Rimell

*Attorney, Agent, or Firm*—Klauber & Jackson

[57] ABSTRACT

An inflatable ballon including an elastically expansible material formed into a closed shape so as to define an expansible chamber therein, the material having an inflation opening for supplying a pressurized gas thereto so as to inflate the material; an upper eye unit having an upper portion and a lower portion partially depressed into a top portion of the material substantially opposite to the inflation opening so that the top portion of the material surrounds the lower portion of the upper eye unit and the upper portion extends out from the material and by which the balloon can be connected to another object; a cylindrical tubular valve extending partially into the inflation opening for supplying the pressurized gas to the chamber, the valve including an inflation channel providing fluid communication between the chamber and ambient atmosphere; a plug insertable into the valve for closing the inflation channel; a lower connecting loop unit secured to a lower portion of the valve that extends from the inflation opening for securing the balloon to another object; and a strengthening joiner cord contained entirely inside of the chamber for connecting the upper eye unit to the valve when the balloon is inflated and for strengtheining the balloon when inflated.

16 Claims, 1 Drawing Sheet

BALLOONS CONNECTED TOGETHER

This application is a continuation of application Ser. No. 107,793, filed Oct. 13, 1987 abandoned.

BACKGROUND OF THE INVENTION

This invention is in the field of toy balloons, inflatables, and plastic spheres and more particularly the area of using these objects for decorating, and artistic sculpture.

Although this segment of the toy balloon industry has grown enormously, problems confronting the balloon decorators, and sculpturers have not been addressed by research and development.

In spite of the limited state of the art, innovative balloon decorators and sculpturers have shown remarkable skill and artistic talent to achieve their goals. They build intricate wire and wood frames, using them as formers, in some cases master strings or cords are used to set the basic pattern for the sculptures or designs. Tying hundreds, sometimes thousands of different sizes of inflated multi-colored balloons to these formers and guides to fill them out, is tedious labor consuming work.

The cost of this labor is probably the major consideration, when a client is contracting for one of these creations or decorating jobs. At special events and trade shows, set up time is a major factor; consequently the time consumed plus the labor cost become a two edged sword working against the balloon decorator and sculpturer. Excluding the new Mylar or foil balloons, the image of a child walking down the street carrying one rubber helium balloon floating on a string, still dominates the latex balloon segment of the industry.

Balloons being connected together in tandem, in groups, or special patterns, seems to have limited disclosure in the art.

T. W. Miller, U.S. Pat. No. 1,220,874 discloses a toy balloon with a valve at its shank or base, a restricting connecting means secured inside of the balloon at its top, this restricting means of a predetermined length then being connected to a valve at the balloon's base. The balloon's inflation opening is then made air-tight around the provided inflation valve. This patent is primarily to restrict the expansion of the balloon at certain points or multiple points and alter its intended round shape. The strength of Miller's restricting means, his valve and his methods of attachment, would be determined to cause the restriction of the balloon only. Conditions such as wind, balloons that will be anchored, heavy pressure on the valve, its restricting means and points of attachment are not considered in Miller's patent. Miller does not make any provisions for his balloons to be connected together in groups or in tandem.

J. Jacobs U.S. Pat. No. 2,008,552 discloses a method to attach toy balloons together, utilizing a mechanical connection which is detectable at will. He supplies a pair of independent shank members which are attached adjacent to each other at points, over the stretched skin of the balloon. This method as stated allows the connectors to be unhooked quite easily from the outside of the inflated balloon. This would severely limit the amount of balloons that could be attached together in tandem. Balloons connected together in this manner for decorating would create problems of how to hang them, drape them or anchor them to a solid object. The pressures on the connections and the skin of the inflated balloons would cause broken connections and mishaped balloons. This would severely limit their versatility.

Using large amounts of balloons, Jacob's method would be very time consuming, limited and not economical.

My own patent, Cornelius J. Wallace U.S. Pat. No. 4,463,513, discloses a method to shape balloons into different configurations, such as an apple, orange, pumpkin etc. In this patent no connectors, loops or eyes are provided at the base valve or at its top to allow balloons to be connected together in groups or in tandem. The interior pliable guide means is primarily provided to restrict the expansion of the inflated balloon at a designated point. The adapter disc is provided to make the indentation at the top of the inflated balloon more pronounced and to prevent the inflation valve from being unnecessarily pulled into the base of the inflated balloon.

The predetermined strength of the inflation valve, the guide means, the adapter disc, the top anchor means and the method of attachment thereof are only relative to causing and controlling this indentation.

Other methods of attaching balloons together used by balloon sculpturers is referred to as a "helix" wherein the balloons are inflated, hand tied, closed and strung 5 or 6 together on an office paper clip, then attached to a guide wire or string. This method is used to form multicolored arches or what is referred to as a "spiral weave". Most methods used by balloon sculpturers and decorators involve the "helix" or hand tying individual balloons to frames or guide wires. This requires time consuming work.

Balloon twisting is also used to connect balloons together, it is pretty limited to forming small figures of birds, people and animals. The innovator is limited to making right angle connections along a pencil shaped balloon. These connections are always at risk of becoming untwisted.

There is another method of forming balloons together in a line, that is by using a long cylindrical shaped, tunnel like mesh net. Inflated balloons are fed into the net by hand and worked along its length to a starting point. A single line of 20–30 inflated 12″ diameter balloons in a mesh net would cover a length of approximately 20′–30′. Nets can be joined together to form designs and arches. The use of the Mylar or silver foil balloons for decorating is very limited and only used as an alternative to the more popular latex or rubber balloons.

All in all, many beautiful decorative effects are achieved by putting balloons in nets tying hundreds of balloons to a master cord or frame, and grouping balloons in clusters such as a "helix". All of these standard methods are labor intensive, tedious and rely primarily on the use of expensive helium gas. The problem of replacing balloons that have become deflated exists. To form a string of single alternating size balloons in tandem is impossible. Spelling a simple word or making a simple figure encompasses the use of wire frames, guide cords or wooden supports. Most of the large decorating jobs are for trade shows, fundraisers, street fairs or special events. They are already on tight set-up schedules themselves. The balloon decorator and sculpturer would welcome any time saving, economical innovation that comes his way.

SUMMARY OF THE INVENTION

With the present, balloons are attached together in tandem or groups, provides a method to incorporate connectors, eyes or loops to both ends of elastically expansible inflated balloons. This allows balloons when inflated to be attached together in groups or strung in a line, in tandem or to form circles. Using predetermined lengths of pliable dividers or lanyards, other lines of inflated balloons may be attached to an originating line at right angles or at different angles. This unrestricted connecting of inflated balloons and lines of balloons together, increases the decorative possibilities of using balloons for this purpose enormously. Different figures, designs and words can be formed faster and more easily as compared to any of the known methods.

The present method of attaching a loop or eye or a connector at the top and base of inflated balloons is accomplished by providing a cylindrical valve with attaching loop or connector at its base near its inflation opening. Holes are provided through the valve's walls at its upper or top portion. An anchor-eye attachment is partially extended into the stretched outer skin of the balloon at its top. From the inside of the deflated balloon, the stretched balloon skin over the lower portion of the anchor-eye is secured together. This securing is accomplished by using one end of a pretermined length and strength of an elongated flexible joiner or strengthener cord. The other end of this joiner or strengthener cord is thread through holes that are provided in walls of the upper portion of the inflation valve. The flexible strengthener cord is then returned to the anchor-eye, where it is again secured over the stretched skin of the balloon and the lower portion of the anchor-eye at the balloon's inside at the top thereof and then made secure. The inflation opening of the balloon is then worked at its shank down and around the unextended strengthener or joiner cord, then over and around the top portion of the provided inflation valve, resulting in covering the holes in the valve's upper portion. The shank of the balloon is then made secure and air-tight around the circumference of the valve, below its center. The lower portion of the inflation valve with its inflation opening and attached loop or eye connector are left uncovered and exposed. A valve plug is provided to seal the valve.

The results of this innovation produce a balloon, whose skin has not been punctured, capable of being inflated with a provided valve, and when inflated it is sealed and made airtight with a valve plug. In an inflated balloon this innovation creates a mechanical axis of predetermined length and strength fully contained inside the inflated balloon and, having an inflation valve of a predetermined size and strength with an attached loop or eye connector exposed at its base and an eye connector exposed at the balloon's top. When heavy pressures are applied at these two connecting points, at the balloon's bottom or base and top, the inflated balloon's skin is not affected and is relieved of supporting any of this pressure.

The amount of pressure capable of being supported by the eyes, loop or connectors of an inflated, balloon would depend on the strength of the mechanical axis' components, the inflation valve with an attached loop or connector, the top anchor eye the strengthening joiner means and the method of attaching these components.

What is presented in elastically expansible balloons is a method to provide reinforced connecting means, eyes or loops at the base and top of inflated balloons. These reinforced connectors will allow numerous amounts of these balloons to be connected together in tandem, in groups as curves or circles, or to spell words. Utilizing pretermined lengths of spacers, dividers or lanyards other lines or circles of inflated balloons may be attached to the original group. Using special sizes of lanyards or spacers a line of balloons may be taken off a primary group at any angle.

The results of being able to connect balloons together in this manner, different sizes, assorted colors, and printed and also being able to incorporate special colored and designed spacers or lanyards into their designs or balloon sculptures, the balloon decorators and sculpturers will have many new avenues of creativity available to them. Enabling long lines of inflated balloons to be supported from the top, straight down or at angles, without using expensive helium is a major accomplishment. The commonly used decorative arches over a line of tables are labor intensive and time consuming. This decoration could be simplified as to time and labor by using this innovation. A single line of balloons, arched across the tables using the connecting joints to add other decorative effects, solves labor and time problems and also adds creative variety to this popular decoration. Using helium gas in conjunction with this new innovation, different effects can be created, that might not be possible, using one or the other. Thus a "wave" effect can be provided and possibly a flag that appears to be waving.

Balloon decorating jobs for trade shows and large convention centers that run for 3–4 or 5 days are a problem. Some of these problems can be solved by using this innovation in conjunction with ambient air filled balloons as opposed to using helium gas. Ambient air is retained much longer in the rubber latex balloons than helium gas. Helium gas has much smaller molecules than ambient air, the balloon's skin is porous, consequently, air stays in the sealed balloon a longer time than helium gas. The use of a liquid called "Hi-Float" put inside inflated balloons to help seal their porous skin would also be of help to keep balloons inflated for a longer time. The problem of having helium balloons escaping up into the high ceiling of some trade shows and convention centers is a real one. One of the larger convention centers in the U.S.A. does not allow the use of helium filled balloons at all on its premises.

The balloons may also be used as "straight ups", that is, the use of ambient air filled balloons, using cylindrical sticks, rods, or dowels to display or carry balloons around upright. They can be placed into pipe openings at trade shows and convention centers, where the metal pipe partitions are popular or taped to sturdy upright fixtures, as decorations or just carried, as in a parade or an entertainment.

The cylindrical sticks, rods or dowels used for this purpose have outside diameters that correspond to the balloons inflation valve's inside diameter. One end of these sticks or rods acts as the balloons sealing plug. I find that a dowel or stick slightly beveled at the sealing end and extending right up through the length of the cylindrical valve, works best for this purpose. Thus the rods or dowels are used as a sealing plug, serve as a carrying means, an attaching means and an anchor means. Standard balloons displayed in this straight up position tilt over, unless a weight, a platform or a support is provided at the base of the inflated balloon. For the more popular size balloons 14", 11", 9", etc., plastic balloon supporting cups are supplied by the trade for this purpose. The method of sealing the inflated balloon, attaching it to the cup, then attaching the plastic stick to the cup, can be a problem sometimes.

No provisions have been made by the trade for supporting the larger balloons in this straight up position, the 30", 40", 4½', 5' and larger balloons, which are becoming very popular for decorating. The larger balloon's heavier rubber skin, the method of sealing them, the problem of exerting a downward pressure on the larger inflated balloon, then attaching the stem to some sort of platform, has not been solved by the balloon industry. Increasing the size of the presently available balloon suspension cups would not be the right answer to this problem.

The present invention provides a strengthened valve at the balloon's inflation opening or stem and having a strengthening axis contained inside an inflated balloon that exerts a downward pressure and using a rod or dowel, provides a good method to seal, to stablize, to attach or to carry balloons in this "straight up" position. By supplying a strengthened supported valve with a mechanical axis inside the balloon, better stabilization can easily be provided. Additional supporting discs or partial saucers or cups can be innovated around the area of the provided balloon's inflation valve to supply the added stability. The advantages of using these balloons as "straight ups" would be using ambient air to replace expensive helium gas, the cost plus transportation, advertising messages, printed on balloons could be set in the most advantageous position, and to decorate locations where helium gas use is restricted. Also the connecting eye at the top of the balloons and the inflation valve area at the base, will open up new areas for other creative endeavors by the balloon decorators and sculpturers.

Having had no adequate method of connecting a rod or controlling carrying stick to inflated balloons, especially the larger balloons, along with lack of "state of the art" innovation pertaining to reinforcing the balloon's skin for special purposes, are probably the main reasons that more balloons are not carried in parades, displayed without using helium gas, are not incorporated in football games, half time shows or are not part of an entertainment in general.

These are comparatively new territories that a competitive balloon industry should be looking into.

Numerals used in the figures indicate the different parts and their function and the balloon's sealing and attachment locations. The figures are not drawn to any specific scale.

DETAILED DESCLOSURE

Figure 1:
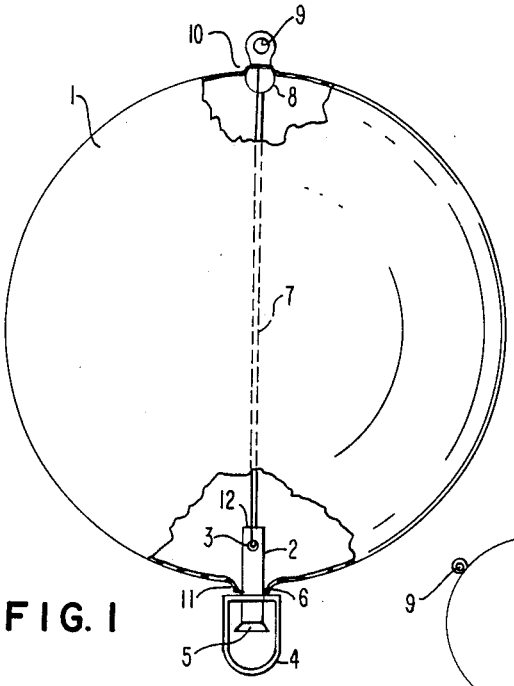
FIG. 1 is an elevational, partially opened view of a fully inflated toy balloon, according to this invention.
Figure 2:
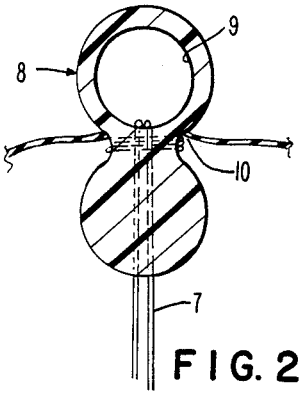
FIG. 2 is an enlarged elevational view, partly in cross-section of the upper eye connector unit with the upper part of the balloon's skin stretched around its base and secured internally from within by using the ends of the flexible strengthening joiner cord.
Figure 3:
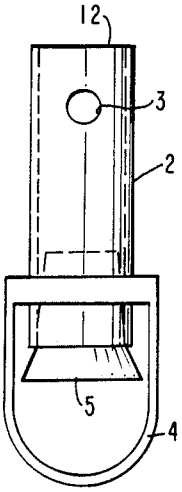
FIG. 3 is an enlarged side view of the elongated cylindrical valve having an attached connecting loop at its base, near the valve's lower inflation opening.

For the purpose of a clear understanding of the principles of the invention, FIGS. 1-3 are situated on the drawing sheet so that any reference to top or upper portion, bottom, lower portion or base, respectively, will correspond to how they are displayed in the figures. For this purpose the inflated balloon in FIG. 1 will be referred to as a front view, the inflation opening of the balloon facing down.

Also for this purpose the balloons shown in the drawings are round balloons. This in no way should limit the scope of this innovation to round balloons only. Elongated, oval, heart shaped, inflatables, inflatable figures and large advertising balloons could at times benefit from the strengthening, attaching and stabilizing results of this innovation.

Referring to FIG. 1 there is shown a fully inflated and sealed balloon 1, having an upper eye unit 8. Upper eye unit 8 has a cross-sectional shape of the numeral "8" and includes a lower anchor section 8*a*, an upper securing section 8*b* and a narrow mid section 8*c* connecting lower anchor section 8*a* to upper securing section 8*b*, the latter provided with a connector hole 9 situated at the balloon top. When balloon 1 is deflated eye unit 8 is partially extended into the top portion of balloon 1 with connector hole 9 of eye unit 8, left exposed. From the inside, the skin of the top portion of balloon 1 is positioned over the lower portion or base of eye unit 8 and is made secure at the place of attaching top 10 as shown best in FIG. 2.

The manner of attaching is accomplished by using one end of a flexible, predetermined, length and strength strengthening-joiner cord 7, wrapped and tied at the place of attaching top 10. The remaining end of strengthening-joiner cord 7 is threaded through holes 3 in upper walls of an inflation valve 2, (FIG. 3), and returned to the place of attaching top 10 and, tied and secured again around mid section 8*c* of eye unit at the top. The whole of strenghtening-joiner cord 7 is contained inside of the uninflated balloon 1 when inflation opening 6 of balloon 1 is worked down over inflation valve 2, covering the holes 3 in the valve walls, and is made airtight around the circumference of valve 2 at the place of attaching bottom 11 just above a connection loop unit 4. This sealing of inflation opening 6 at attaching point bottom 11 results in the inflation channel 12 of valve 2 being the innovative balloon's only inflation opening.

The innovative balloon in FIG. 1 has been inflated and then sealed with a provided valve plug 5, unhindered by connecting loop unit 4 that is attached to the base of valve 2. FIG. 3 is a side view of the cylindrical inflation valve 2. It is provided with a removable valve sealing plug 5 and has an inflation channel 12 through its core. The lower portion of valve 2 is equipped with a connection loop unit 4 which can be a permanent part of valve 2 or independent thereof and then made secure to the inflation valve 2.

Connecting loop unit 4 is spaced from the lower open portion of valve 2 so as to provide a clearance therebetween for fast insertion of valve plug 5, when inflated balloon 1 is ready to be sealed air-tight. The upper portion of valve 2 has holes 3 through its walls used as a means to attach strenghtening joiner cord 7 to inflation valve 2 as shown in FIG. 1 and FIG. 3. Shown in FIG. 2 is an enlarged front view of upper eye unit 8 with connector hole 9 at its top portion. The "8" shaped configuration thereof is just one of many possible shapes that can be adapted for this part. The connector hole 9 fashioned in the form of a snap-ring would be an advantageous variation. FIG. 2 also shows in more detail the method of internally attaching the top of the balloon's skin to upper eye unit 8 at attaching point 10 using the ends of the strengthening joiner cord 7, which is of a predetermined length and strength is flexible and has been threaded through holes 3 in the walls of valve 2.

Figure 4:
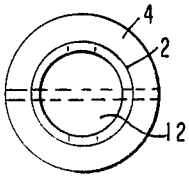
FIG. 4 is a top view of the cylindrical inflation valve, showing the inflation opening, the valve's walls and the attached connecting loop unit.

FIG. 4 is a top view of cylindrical valve 2, detailing the location of attaching loop unit 4 to inflation valve 2.

Figure 5:
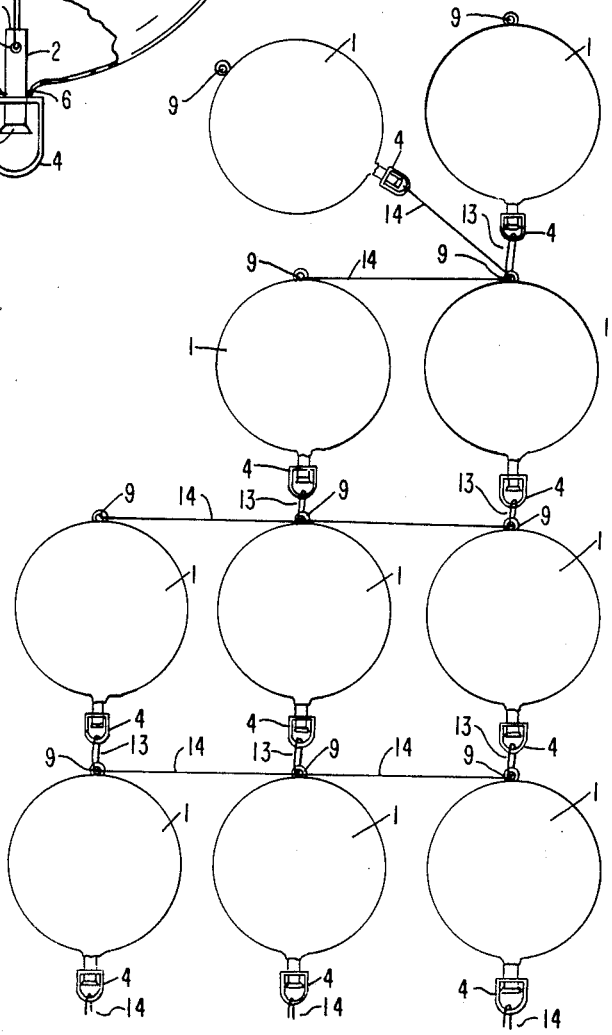
FIG. 5 is an elevational view, showing how balloons can be connected together, in tandem, in groups or at different angles, using predetermined size and strengthened spacers, dividers or lanyards with attaching means.

FIG. 5 illustrates a plurality of balloons 1 connected together in a group, in tandem, and at angles utilizing pre-determined size and strength spacers, dividers or lanyards 14 in conjunction with the balloon's connecting points 9 and 4 and using attaching means 13, such as split rings, two way swivels or ordinary string. In some cases the connecting means used on the spacers or lanyards 14 can eliminate the use of attaching means 13. As shown in FIG. 5 a ladder like effect can be created and illustrates the infinite number of ways inflated innovative balloons using dividers or spacers 14 can be connected together to form designs, patterns, figures and spell words. Incorporating colorful innovatively designed, rigid or non-rigid spacers 14 will also contribute to forming other new artistic creations, using balloons, that were not possible before this innovation.

Connecting the inflated balloons together in almost unlimited numbers, therefore provides distinct advantages. This would apply indoors and outdoors. This innovation relieves the thin skin of the balloons from supporting these additional pressures and losing their shape.

It should be understood that the theory "a chain is only as strong as its weakest link" would definitely apply to this innovation and the method used to connect the balloons together. Consequently the design of and the material used for the innovative parts, rigid or non-rigid any incorporation of the parts, the methods of attachment, without damaging the skin of the balloons, the design and strength of the dividers or lanyards, would always be relative to this theory.

The use of a round toy balloon for illustration purposes, should not restrict this innovation to round balloons only. All shapes of balloons at some time or other could benefit from a strengthening-axis that supplies these reinforced connecting points. The inflatables, the spheres, the larger display balloons are all potential uses of this innovation.

I claim:

1. An inflatable balloon comprising:

an elastically expansible material formed into a closed shape so as to define an expansible chamber therein, said material having an inflation opening for supplying a pressurized gas thereto so as to inflate said material;

an upper eye unit having an upper connector portion and a lower portion partially depressed into a top portion of said material substantially opposite to said inflation opening so that the top portion of said material surrounds said lower portion of said upper eye unit and said upper connector portion extends out from said material and by which said balloon can be connected to another object;

valve means extending partially into said inflation opening for supplying the pressurized gas to said chamber, said valve means including an inflation channel providing fluid communication between said chamber and ambient atmosphere;

plug means insertable into said valve means for closing said inflation channel;

lower connecting means secured to a lower portion of said valve means that extends from said inflation opening for securing said balloon to another object; and strengthening cord means contained entirely inside of said chamber for connecting said upper eye unit to said lower connecting means when said balloon is inflated and for strengthening said balloon when inflated, said strengthening cord means securing said top portion of said material about the lower portion of said upper eye unit and said strengthening cord means being connected directly to said valve means and indirectly to said lower connecting means through said valve means such that, when a tensioning force is applied on one of said upper eye unit and said lower connecting means, such force is transmitted to the other of said upper eye unit and said lower connecting means primarily through said strengthening cord means.

2. A balloon according to claim 1, wherein said upper portion of said upper eye unit includes a connector hole by which said balloon can be connected to another object.

3. A balloon according to claim 1, wherein said valve means includes a cylindrical tube defining a channel therein, said tube being open at an upper end thereof extending into said chamber and being open at a lower end thereof exposed to the ambient atmosphere.

4. A balloon according to claim 3, wherein said plug means and said lower open end of said tube are dimensioned so that said plug means will close said channel when said plug means is inserted into said lower open end of said tube.

5. A balloon according to claim 1, wherein said tube includes a wall with at least one transverse hole therethrough, and said strengthening joiner means is connected to said valve means through said at least one transverse hole.

6. A balloon according to claim 5, wherein said strengthening joiner means includes a cord extending through said at least one transverse hole.

7. A balloon according to claim 6, wherein said cord extends around said top portion of the material so as to secure said top portion of the material around said lower portion of said upper eye unit, down through said at least one transverse hole, and up to said top portion of the material where said cord is secured to itself.

8. A balloon according to claim 1, wherein said strengthening joiner means includes a cord contained entirely inside of said chamber, said cord connecting said upper eye unit to said valve means in a taut manner when said balloon is inflated.

9. A balloon according to claim 1, wherein said lower connecting means includes a connecting loop secured to the lower portion of said valve means that extends from said inflation opening for securing said balloon to another object.

10. A balloon according to claim 9, wherein said connecting loop includes a lower portion spaced from a lower end of said valve means so as to provide a clearance therebetween so as to permit said plug means to be inserted in said lower end of said valve means.

11. A balloon arrangement comprising:

(a) a plurality of inflatable balloons, each balloon including:

(i) an elastically expansible material formed into a closed shape so as to define an expansible chamber therein, said material having an inflation opening for supplying a pressurized gas thereto so as to inflate said material;

(ii) an upper eye unit having an upper connector portion and a lower portion partially depressed into a top portion of said material substantially opposite to said inflation opening so that the top portion of said material surrounds said lower portion of said upper eye unit and said upper connector portion extends out from said material;

(iii) valve means extending partially into said inflation opening for supplying the pressurized gas to said chamber, said valve means including an inflation channel providing fluid communication between said chamber and ambient atmosphere;

(iv) plug means insertable into said valve means for closing said inflation channel;

(v) lower connecting means secured to a lower portion of said valve means that extends from said inflation opening for securing said balloon to another object; and (vi) strengthening cord means contained entirely inside of said chamber for connecting said upper eye unit to said lower connecting means when said balloon is inflated and for strengthening said balloon when inflated, said strengthening cord means securing said top portion of said material about the lower portion of said upper eye unit and said strengthening cord means being connected directly to said valve means and indirectly to said lower connecting means through said valve means such that, when a tensioning force is applied on one of said upper eye unit and said lower connecting means, such force is transmitted to the other of said upper eye unit and said lower connecting means primarily through said strengthening cord means; and (b) attaching means for selectively connecting at least one of (i) said upper eye unit and (ii) said lower connecting means of each balloon to at least one of (iii) an upper eye unit and (iv) lower connecting means of another said balloon.

12. A balloon according to claim 11, wherein said upper portion of said upper eye unit includes a connector hole by which said balloon can be connected to another object.

13. A balloon according to claim 11, wherein said lower connecting means includes a connecting loop secured to the lower portion of said valve means that extends from said inflation opening for securing said balloon to another object.

14. A balloon according to claim 11, wherein said attaching means includes a lanyard.

15. A balloon according to claim 14, wherein said upper portion of said upper eye unit includes a connector hole by which said balloon can be connected to another object, and said attaching means has one end connected to said connector hole.

16. A balloon according to claim 15, wherein said lower connecting means includes a connecting loop secured to the lower portion of said valve means that extends from said inflation opening for securing said balloon to another object, and said attaching means has one end connected to said connecting loop.

* * * * *